US005932384A

United States Patent [19]

Mitsumori et al.

[11] Patent Number: 5,932,384

[45] Date of Patent: Aug. 3, 1999

[54] ELECTROPHOTOGRAPHIC PHOTORECEPTOR

[75] Inventors: Teruyuki Mitsumori; Takayuki Shouda; Akiteru Fujii; Mikiko Sato, all of Yokohama, Japan

[73] Assignee: Mitsubishi Chemical Corporation, Tokyo, Japan

[21] Appl. No.: 09/078,503

[22] Filed: May 14, 1998

[30] Foreign Application Priority Data

May 14, 1997 [JP] Japan ..... 9-124135
May 14, 1997 [JP] Japan ..... 9-124136
May 14, 1997 [JP] Japan ..... 9-124137

[51] Int. Cl.[6] ..... G03G 5/047; G03G 5/09

[52] U.S. Cl. ..... 430/59; 430/58; 430/83

[58] Field of Search ..... 430/58, 59, 83

[56] References Cited

U.S. PATENT DOCUMENTS 4,588,666 5/1986 Stolka et al. ..... 430/59
4,724,192 2/1988 Makino et al. .
4,988,595 1/1991 Pai et al. ..... 430/59
5,272,031 12/1993 Hanatani et al. ..... 430/59
5,294,509 3/1994 Ashiya et al. ..... 430/58
5,494,766 2/1996 Dohi et al. ..... 430/83
5,573,878 11/1996 Hagiwara et al. ..... 430/59

OTHER PUBLICATIONS

Patent Abstracts of Japan, JP 6–11854, Jan. 21, 1994.
Patent Abstracts of Japan, JP 63–48553, Mar. 1, 1988.
Patent Abstracts of Japan, JP 2–154269, Jun. 13, 1990.
Patent Abstracts of Japan, JP 4–290851, Oct. 15, 1992.
Patent Abstracts of Japan, JP 62–139563, Jun. 23, 1987.
Patent Abstracts of Japan, JP 7–036203, Feb. 7, 1995.

*Primary Examiner*—Roland Martin
*Attorney, Agent, or Firm*—Oblon, Spivak, McClelland, Maier & Neustadt, P.C.

[57] ABSTRACT

An electrophotographic photoreceptor having a photosensitive layer containing a charge generation material and a charge transport material on an electroconductive substrate, wherein the charge transport material has a polarizability $\alpha$ of the formula, $\alpha>100$ ($Å^3$) and a dipole moment P of the formula, $P<1.6$ (D).

24 Claims, 1 Drawing Sheet

ELECTROPHOTOGRAPHIC PHOTORECEPTOR

BACKGROUND OF THE INVENTION

1. Field of the Invention

The present invention relates to an electrophotographic photoreceptor. More particularly, the present invention relates to an electrophotographic photoreceptor having a high sensitivity, which comprises a photosensitive layer containing an organic photoconductive material.

2. Description of the Prior Art

Heretofore, an inorganic photoconductive material such as selenium, cadmium sulfide or zinc oxide has been widely used in a photosensitive layer of an electrophotographic photoreceptor. However, these inorganic photoconductive materials have disadvantages that selenium and cadmium sulfide must be recovered since they are toxic materials, that selenium is poor in heat resistance since it is crystallized by heat, that cadmium sulfide and zinc oxide are poor in moisture resistance, and that zinc oxide is poor in printing resistance, and accordingly an effort for developing a novel photosensitive material has been continuously made. Recently, a research for using an organic photoconductive material in a photosensitive layer of an electrophotographic photoreceptor has been progressed, some of which have been practically utilized. As compared with an inorganic photoconductive material, an organic photoconductive material has advantages that it is light, that a film can be easily formed, that it is easy to prepare a photosensitive material, and that it is possible to produce a transparent photosensitive material depending on its kind.

Recently, a separate function type photosensitive material in which a function of generating a charge carrier and a function of transporting the carrier are separately carried on respective compounds, has been mainly developed, since it is effective for providing a high sensitivity, and accordingly, this type of organic photosensitive material has been practically utilized.

As a charge carrier transporting medium (hereinafter referred to as "CTM"), there are a case of using a high molecular photoconductive compound such as polyvinylcarbazole and a case of dispersing and developing a low molecular photoconductive compound in a binder polymer.

Particularly, an organic low molecular photoconductive compound can easily provide a photosensitive material having excellent mechanical properties since a polymer excellent in film-formability, flexibility and adhesiveness can be selected as a binder (see, for example, JP-A-63-172161, JP-A-63-174053, JP-A-4-267261 and JP-B-5-15259).

Examples of performances required for an electrophotographic photoreceptor include (1) a chargeability by corona discharge in the dark is high, (2) a decay of a surface potential by corona charge in the dark is small, (3) a decay of a surface potential by light exposure is large, (4) a residual potential after light exposure is small, and (5) when repeatedly used, variation in a surface potential, lowering of a sensitivity and accumulation of a residual potential are small, and consequently a satisfactory durability can be provided.

Particularly, when a residual potential is large, a charge remains also on exposed parts, and when development by a toner is made, the toner is developed also on non-image parts, which causes a fogged image. Further, in a case of reverse development used often in a printer, an image density or a contrast is lowered, and in an extreme case, a toner is not deposited on an image part, which causes a void image. In these cases, reproducibility of an image is extremely lowered, and is not practically usable. Recently, in proportion to the spread of a laser printer employing a reverse development system, there is strongly demanded development of CTM having a high sensitivity, a low residual potential, a high mobility and a satisfactory durability, which is suitable for combining with a charge generating material for a long wavelength light such as a phthalocyanine type pigment.

SUMMARY OF THE INVENTION

The present inventors have extensively studied an organic low molecular photoconductive compound providing an electrophotographic photoreceptor having a high sensitivity, a low residual potential, a high mobility and a satisfactory durability, and discovered that a molecule satisfying a specific parameter is preferable for this object, and the present invention is based on this discovery.

Thus, the first essential feature of the present invention resides in an electrophotographic photoreceptor having a photosensitive layer containing a charge generation material and a charge transport material on an electroconductive substrate, wherein the charge transport material has a polarizability $\alpha$ of the formula, $\alpha>100$ (Å$^3$) and a dipole moment P of the formula, $P<1.6$ (D).

The second essential feature of the present invention resides in an electrophotographic photoreceptor having a photosensitive layer containing a charge generation material and a charge transport material on an electroconductive substrate, wherein the charge transport material has a polarizability $\alpha$ of a calculated value $\alpha$cal of the formula, $\alpha cal>70$ (Å$^3$) by structure-optimization calculation in accordance with semi-empirical molecular orbital calculation using PM3 parameter (hereinafter simply referred to as "semi-empirical molecular orbital calculation") and a dipole moment P of a calculated value Pcal of the formula, $Pcal<1.8$ (D), by semi-empirical molecular orbital calculation.

Further, the third essential feature of the present invention is to provide the following compound which is a charge transport material satisfying the above conditions. Thus, the third essential feature of the present invention resides in an electrophotographic photoreceptor having a photosensitive layer containing an arylamine type compound of the following formula (1) on an electroconductive substrate:

(1)

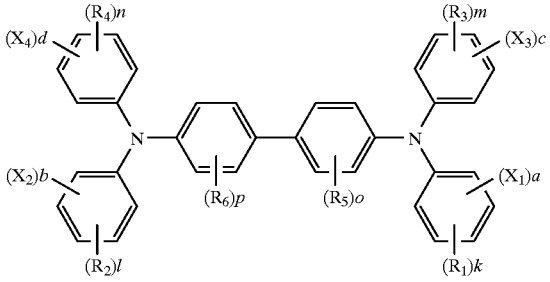

wherein in the formula (1), each of $R_1$, $R_2$, $R_3$, $R_4$, $R_5$ and $R_6$ is a halogen atom, an alkyl group which may have a substituent, an alkoxy group which may have a substituent, an aryl group which may have a substituent or a substituted amino group, and they may be the same or different; each of k, l, m, n, o and p is an integer of from 0 to 4, and when the integer is 2 or more, a plurality of $R_1$ to $R_6$ may the same or different; $X_1$ is a group of the formula (2), $$-(CR_7=CR_8)_i-CR_9=CR_{10}R_{11} \quad (2)$$

and each of $X_2$, $X_3$ and $X_4$ is a group of the formula (2'), $$-(CR_{12}=CR_{13})_h-CR_{14}=CR_{15}R_{16} \quad (2')$$

(in the formulas (2) and (2'), i is an integer of at least 1, h is an integer of 0 or more, each of $R_7$, $R_8$, $R_9$, $R_{10}$, $R_{11}$, $R_{12}$, $R_{13}$, $R_{14}$, $R_{15}$ and $R_{16}$ is a hydrogen atom, an alkyl group which may have a substituent, an alkoxy group which may have a substituent, an aryl group which may have a substituent or a heterocyclic group which may have a substituent, and they may the same or different, provided that in respect to the pair of $R_{10}$ and $R_{11}$ or the pair of $R_{15}$ and $R_{16}$, when one is a hydrogen atom or an alkyl group, the other is an aryl group or a heterocyclic group, or the pair of $R_{10}$ and $R_{11}$ or the pair of $R_{15}$ and $R_{16}$ may be condensed to form a carbocyclic group or a heterocyclic group, and when i is 2 or more, each of $R_7$ and $R_8$ may be the same or different, and when h is 2 or more, each of $R_{12}$ and $R_{13}$ may be the same or different), and they may be respectively the same or different; and each of a, b, c and d is an integer of 1 or 2.

DETAILED DESCRIPTION OF THE INVENTION

Figure 1:
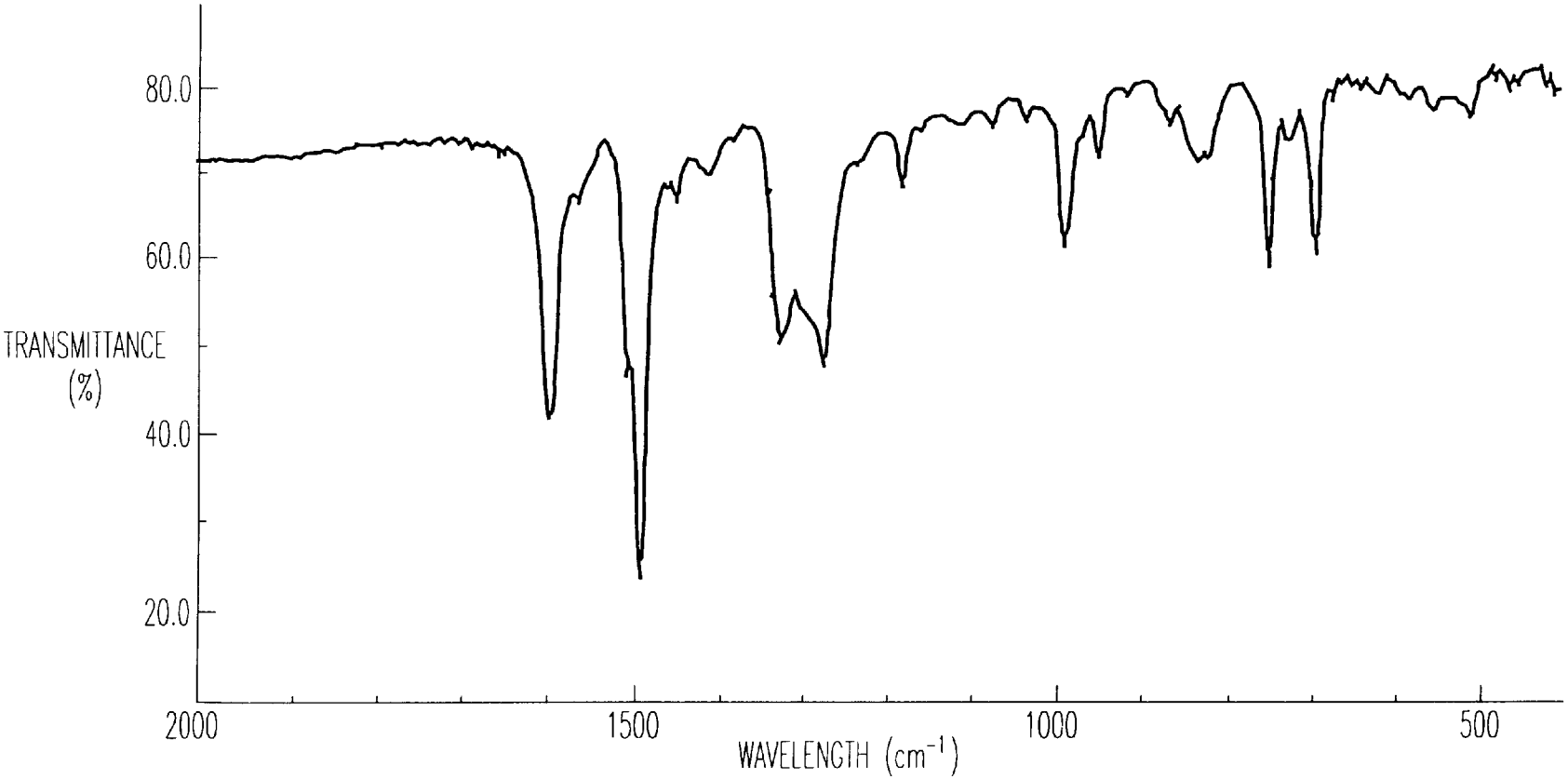
FIG. 1 illustrates an infrared absorption spectral chart of Compound No. 4 of Table 1.

The present invention is further described in more details.

An electrophotographic photoreceptor excellent in mobility, chargeability, sensitivity and residual potential can be obtained by using an organic charge transport material having a polarizability $\alpha$ of the formula, $$\alpha>100\ (\text{Å}^3)$$

and a dipole moment P of the formula, $$P<1.6\ (D).$$

Further, when the polarizability $\alpha$ and the dipole moment P are determined by semi-empirical molecular orbital calculation using PM3 parameter, the calculated value $\alpha$cal of the polarizability $\alpha$ should preferably satisfy the formula, $$\alpha cal>70\ (\text{Å}^3)$$

and the calculated value Pcal of the dipole moment P should preferably satisfy the formula, $$Pcal<1.8\ (D).$$

As mentioned above, the polarizability and the dipole moment of an organic charge transport material were determined by semi-empirical molecular orbital calculation. According to the molecular orbital method, wave function used in Schroedinger equation is approximated by Slater determinant consisting of a molecular orbit expressed by linear bond of an atomic orbit, and the molecular orbit constituting the wave function is determined by approximation of self-consistent field (abbreviated as "SCF"), thereby calculating various physical amounts as total energy, wave function and wave function expected value. The semi-empirical molecular orbital calculation method comprises reducing a long integral calculation time by parametering with various empirical values and approximating when determining the molecular orbit by approximation of self-consistent field. In the present invention, PM3 parameter set is used as the semi-empirical parameter, and calculation is made by using version MOPAC93 of semi-empirical molecular orbital calculation program MOPAC (see J. J. P. Stewart, Journal of Computer-Aided Molecular Design, 4, 1 (1990) and the literatures cited therein with regard to PM3 and MOPAC).

The present inventors have studied the reason why a charge transport material having the above specific parameters provides excellent performances.

That is, the present inventors have noted that overlapping of orbits between adjacent electron transport materials and a change in charge distribution to electric field (including a local electric field) largely participate in organic electron transport system, and therefore studied polarizability and dipole moment of the charge transport material.

It is considered that when the spread of an electron cloud of a charge transport material is large, overlapping of the electron cloud with an adjacent charge transport material in a charge transport layer becomes large, and consequently electrons are easily transferred, thereby making mobility large. On the other hand, it is considered that when the spread of an electron cloud is large, an electron is liable to be weakly bound by an atomic nucleus having a positive charge, and a change in charge distribution caused when applying an electric field becomes large. Thus, it is considered that the mobility of a charge transport material becomes large when a polarizability causing a change in charge distribution generated by applying an electric field to a molecule is large.

Also, when a carrier (organic charge transport material ion) is present in a charge transport layer, an organic charge transport material having a large dipole moment provides a large interaction energy workable with a charge of the carrier and a dipole moment of adjacent organic charge transport material, and obtains a large stabilization energy, and consequently a large activation energy is required when transporting charges between adjacent organic charge transport material molecules. Therefore, it is an important factor for realizing a high mobility to satisfy the condition that the dipole moment is small to some degree.

From the above reasons, it is considered that a charge transport material having the above specific polarizability and dipole moment provides a high mobility.

Among these conditions, the polarizability $\alpha$ is preferably $\alpha>115$ (Å$^3$), more preferably $\alpha>130$ (Å$^3$).

Also, the dipole moment P is preferably P<1.5 (D), more preferably P<1.4 (D).

Further, the $\alpha/P$ value is preferably $\alpha/P>60$, more preferably $\alpha/P>70$.

Still further, among molecules satisfying claim 1, a material satisfying the formula, $$\alpha/Mw>0.15\ (\text{Å}^3)$$

($\alpha$: polarizability, Mw: molecular weight)

has a higher mobility, and the electrophotographic photoreceptor having excellent chargeability, sensitivity and residual potential can be obtained by using this organic charge transport material and charge generation material.

Among materials having the same polarizability α, a material having a smaller molecular weight achieves the effect of the present invention more efficiently since such a material is present in a larger mol number in the photoreceptor.

This value is preferably α/Mw>0.155 (Å$^3$), more preferably α/Mw>0.16 (Å$^3$).

The calculated value αcal of the polarizability is preferably αcal>80 (Å$^3$), more preferably αcal>85 (Å$^3$), still more preferably αcal>90 (Å$^3$).

Also, the calculated value Pcal of the dipole moment is preferably Pcal<1.7(D), more preferably Pcal<1.65(D).

Further, the value of αcal/Pcal is preferably αcal/Pcal>75 (Å$^3$/D), more preferably αcal/Pcal>80 (Å$^3$/D).

Among materials satisfying claim 13, a material having a calculated value of polarizability per molecular weight of αcal/Mw>0.11 (Å$^3$) (αcal: calculated value of polarizability by semi-empirical molecular orbital calculation, Mw: molecular weight) or having a calculated value of polarizability per unit volume of αcal/V>0.11 (αcal: calculated value of polarizability by semi-empirical molecular orbital calculation, V: calculated value of van der Waals volume of a molecule having a molecular structure determined by semi-empirical molecular orbital calculation method) provides a high mobility, and an electrophotographic photoreceptor having excellent chargeability, sensitivity and residual potential can be obtained by using this organic charge transport material and charge generation material.

Among molecules having the same polarizability, a material having a smaller molecular weight achieves efficiently the effect of the present invention since such a material is present in a larger mol number in the photoreceptor.

In order to provide a high mobility and a high sensitivity, it is preferable to satisfy the conditions of preferably αcal/Mw>0.115 (Å$^3$) or αcal/V>0.115, more preferably αcal/Mw>0.12 (Å$^3$) or αcal/V>0.12.

The molecular weight of a charge transport material is preferably at most 10,000.

In order to provide a high sensitivity, an ionization potential difference between a charge transport material and a charge generation material is preferably within 0.4 eV, more preferably within 0.3 eV. Further, in order to provide a high sensitivity, an ionization potential difference between a charge generation layer and a charge transport layer is preferably within 0.2 eV, more preferably within 0.1 eV.

Still further, in order to provide a high sensitivity and a low residual potential, an ionization potential of the charge transport material is from 5 to 5.4 eV.

Also, a calculated value of ionization potential by semi-empirical molecular orbital calculation of the charge transport material is preferably from 7.9 to 8.3 eV in order to provide a high sensitivity and a low residual potential.

A polarizability and a dipole moment of an organic charge transport material can be easily determined from measured values of a refractive index and a dielectric constant to a dilute solution of the organic charge transport material in accordance with the method described in J. Chem. Phys. 75, 3572 (1981) by K. D. Singer and A. F. Garito.

Each calculated value of a polarizability, a dipole moment and an ionization potential of an organic charge transport material can be easily determined by using a MOPAC93.

According to the present invention, a satisfactory optimum electrophotographic photoreceptor can be estimated by calculating a polarizability and a dipole moment with regard to an organic charge transport material without synthesizing, and therefore a satisfactory electrophotographic photoreceptor can be easily produced by using an optimum organic charge transport material.

Further, according to the present invention, a satisfactory optimum electrophotographic photoreceptor can be estimated by determining a polarizability and a dipole moment of an organic charge transport material, and therefore a satisfactory electrophotographic photoreceptor can be easily produced by using an optimum organic charge transport material.

Examples of the organic charge transport material in the present invention are illustrated in the following Table 1.

TABLE 1

No. 1

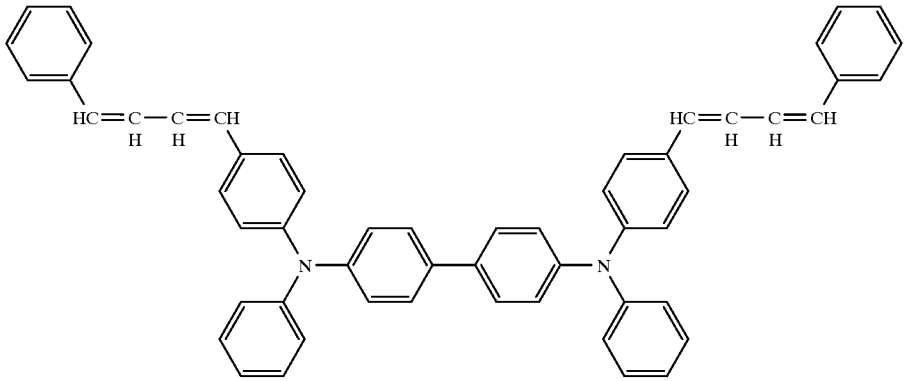

TABLE 1-continued
No. 2
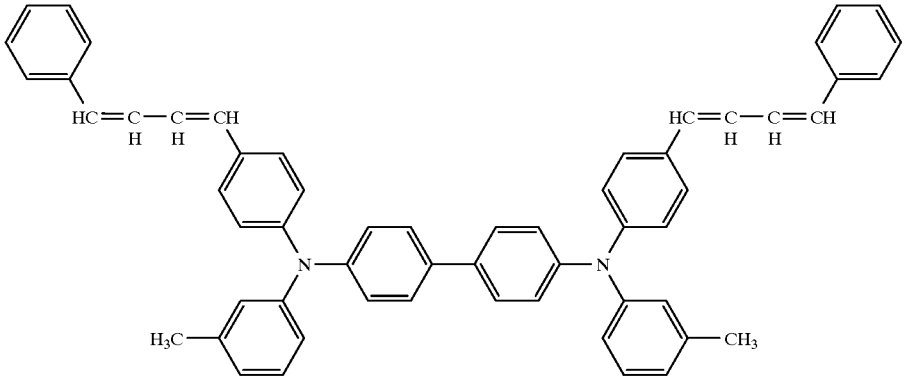
No. 3
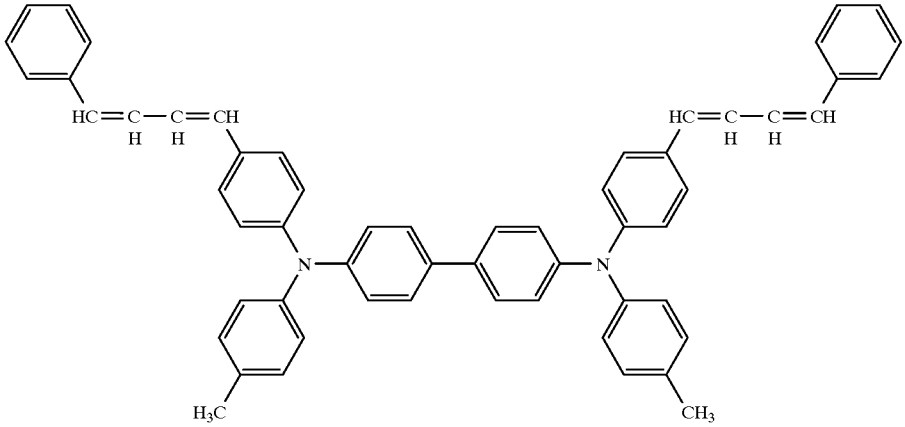
No. 4
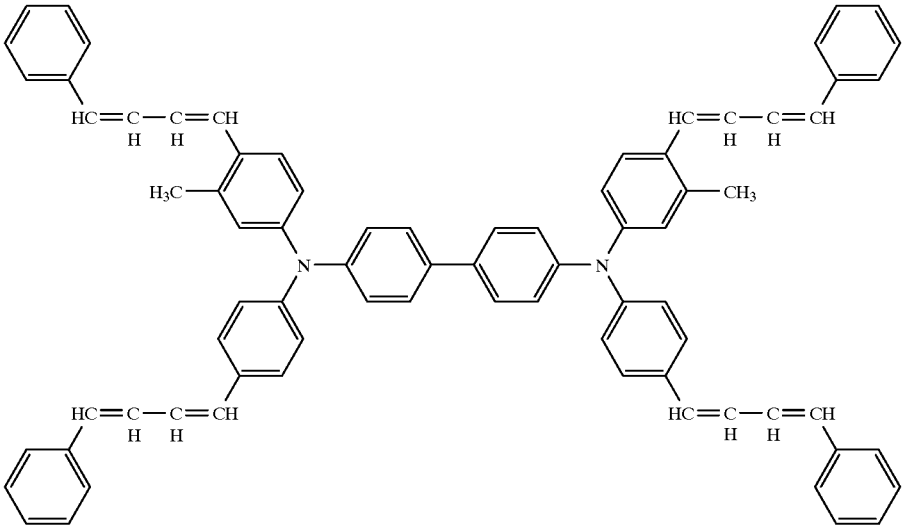

TABLE 1-continued
No. 5
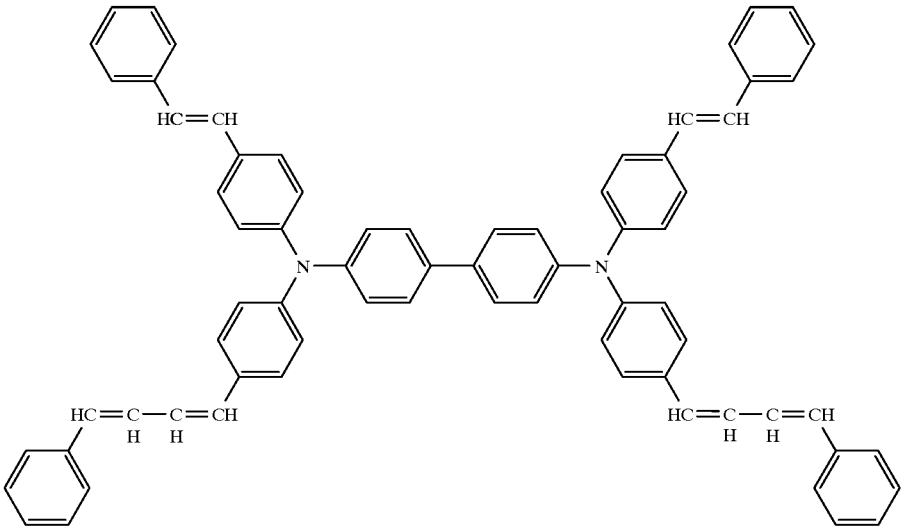
No. 6
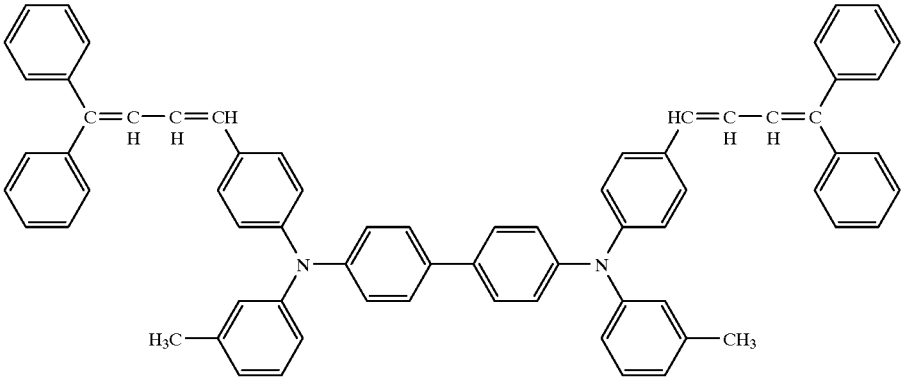
No. 7
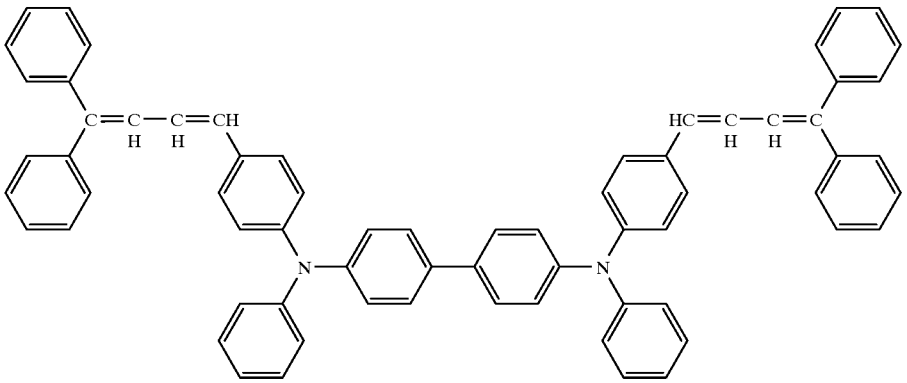

TABLE 1-continued
No. 8
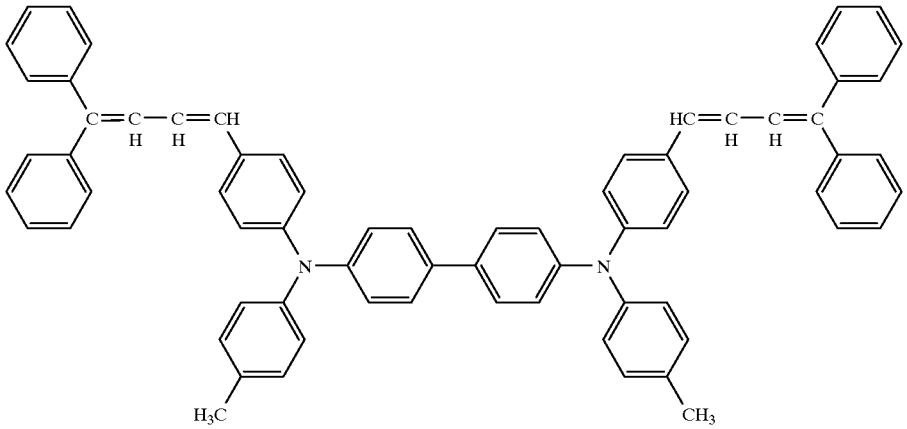
No. 9
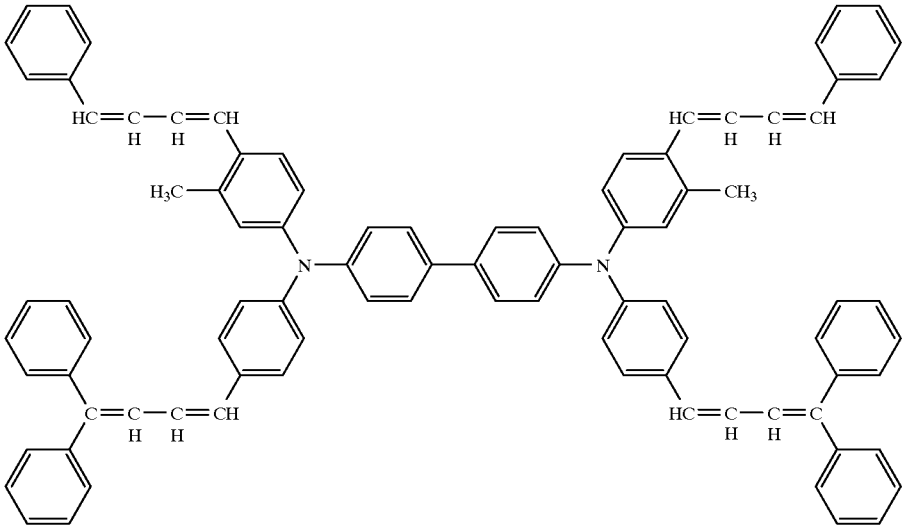
No. 10
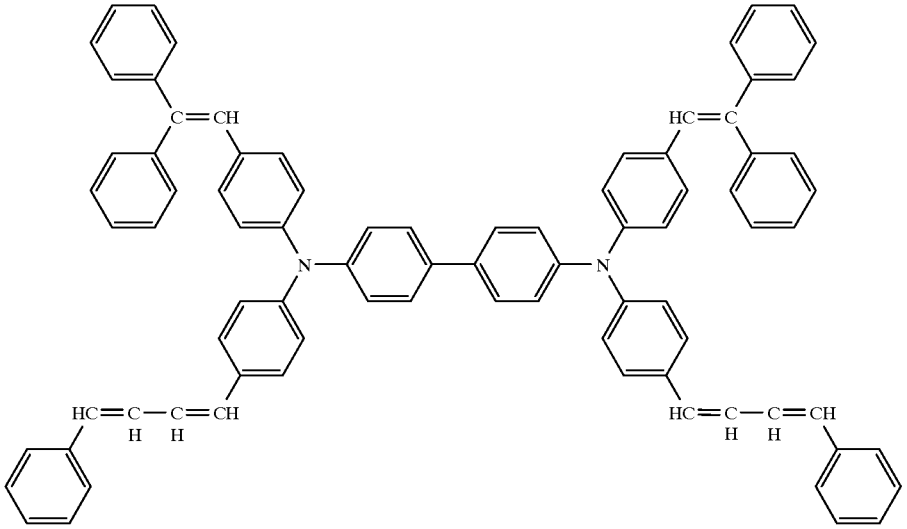

As a photosensitive layer of an electrophotographic photoreceptor, various forms are known, but any form of photosensitive layer can be used as a photosensitive layer of the electrophotographic photoreceptor of the present invention.

For example, any form of photosensitive layer (photoconductive layer) can be used, such as a laminated type photosensitive layer wherein a charge generation layer and a charge transport layer are laminated in this order or in reverse order, or a dispersion type photosensitive layer wherein particles of a charge generation material are dispersed in a charge transport medium.

Examples of the photosensitive layer include a photosensitive layer having a charge transport medium and, if necessary, a coloring matter as a sensitizer and an electron-attractive compound added to a binder, a photosensitive layer having a charge generation material (photoconductive particle) generating a charge carrier at a very high efficiency when absorbing light and a charge transport medium added to a binder, and a photosensitive layer obtained by laminating a charge generation layer comprising a charge transport medium and a binder and a charge generation layer comprising a charge generation material generating a charge carrier at a very high efficiency when absorbing light and/or a binder.

These photosensitive layers may further contain well known other arylamine compounds, hydrazone compounds, stilbene compounds or the like which have excellent performances as organic photoconductors.

According to the present invention, an excellent electrophotographic photoreceptor having a high sensitivity, a small residual potential, and a small change in a surface potential, a small degradation in a sensitivity, a small accumulation of a residual potential and a satisfactory durability even when repeatedly used, can be obtained by using a photosensitive layer comprising two layers of a charge transport layer (a charge transfer layer) and a charge generation layer containing a charge transport medium satisfying specific parameters.

For example, a laminated type photosensitive layer can be prepared by forming a charge generation layer by directly vapor-depositing a charge generation material or coating a dispersion of a charge generation material and a binder, and forming a charge transport layer by casting an organic solvent solution containing the above charge transport medium or coating a dispersion of the charge transport medium and a binder dissolved. The charge generation layer and the charge transport layer may be laminated in reverse order.

Also, it is possible to use a monolayer type photoreceptor prepared by coating a solution containing a charge generation material and a charge transport material dispersed and dissolved in a binder on an electroconductive substrate.

Examples of the charge generating material include inorganic photoconductive particles such as selenium, selenium-tellurium alloy, selenium-arsenic alloy, cadmium sulfide, amorphous silicon and the like; and organic photoconductive particles such as non-metallic phthalocyanine, metal-containing phthalocyanine, perinone type pigment, thioindigo, quinacridone, perillene type pigment, anthraquinone type pigment, azo type pigment, bisazo type pigment, trisazo type pigment, tetrakis type azo pigment, cyanine type pigment and the like. Further, various organic pigment and dyes such as polycyclic quinone, pyrylium salt, thiopyrylium salt, indigo, anthanthrone, pyranthrone and the like can be used. Among them, non-metallic phthalocyanine, phthalocyanines having metal, its oxide or chloride such as copper, indium chloride, gallium chloride, tin, oxytitanium, zinc, vanadium or the like coordinated, and monoazo, bisazo, trisazo or polyazo type azo pigments are preferable.

Preferable examples of a coupler for an azo type pigment include those of the following formula (I) and/or (II).

(I)

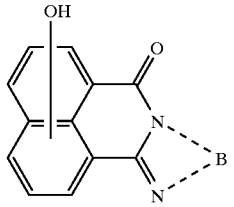

(II)

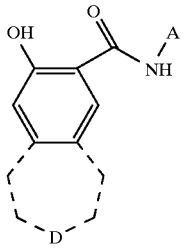

Further, among them, a combination of metal-containing phthalocyanine or non-metallic phthalocyanine with the above charge transport material provides a satisfactory electrophotographic photoreceptor having an improved sensitivity to laser light. Particularly, an electrophotographic photoreceptor having a photosensitive layer containing at least a charge generation material and a charge transport material on a photoconductive substrate, the charge generation material of which is oxytitanium phthalocyanine having the main diffraction peak at a Bragg angle (2θ±0.2°) of 27.3° of X-ray diffraction spectrum, is preferable.

The electrophotographic photoreceptor thus obtained has a high sensitivity, a low residual potential and a high chargeability, and is usable as a highly durable photoreceptor since property variation is small and a charge stability having an influence on an image density is satisfactory even when repeatedly used. Further, since this photoreceptor has a high sensitivity to a light in the wavelength range of from 750 to 850 nm, this photoreceptor is particularly suitable for a semiconductor laser printer.

A preferable oxytitanium phthalocyanine used as a charge generation material as the main diffraction peak at a Bragg angle (2θ±0.2°) of 27.3° in X-ray diffraction spectrum. The term "main diffraction peak" means the highest intensity peak in X-ray diffraction spectrum.

The X-ray diffraction spectrum of oxytitanium phthalocyanine powder used exhibits the main diffraction peak at a Bragg angle (2θ±0.2°) of 27.3°, and the small peaks vary depending on various conditions, but their intensities of the other peaks (comparison of peak height) should preferably be not higher than 50% to the main peak intensity at 27.3° in view of chargeability and sensitivity.

Oxytitanium phthalocyanine particles having the main diffraction peak at a Bragg angle (2θ±0.2°) of 27.3° in X-ray diffraction spectrum are dissolved or dispersed, if necessary, together with other organic photoconductive compounds, coloring matters, electron-attractive compounds or the like, and the coating solution thus obtained is coated and dried to form a charge generation layer. Further, it is preferable to use the above oxytitanium phthalocyanine having the main diffraction peak at a Bragg angle (2θ±0.2°) of 27.3° in X-ray diffraction spectrum in combination with an oxytitanium phthalocyanine having the main diffraction peaks at Bragg angles (2θ±0.2°) of 9.3°, 13.2°, 26.2° and 27.1° in X-ray diffraction spectrum or a dichlorotin phthalocyanine having the main diffraction peaks at Bragg angles (2θ±0.2°) of 8.5°, 12.2°, 13.8°, 16.9°, 22.4°, 28.4° and 30.1° in X-ray diffraction spectrum.

EXAMPLES

Example 1

1.0 Part of a titanium oxyphthalocyanine pigment having intense diffraction peaks at Bragg angles (2θ±0.2°) of 9.3°, 10.6°, 13.2°, 15.1°, 15.7°, 16.1°, 20.8°, 23.3° and 27.1° of X-ray diffraction spectrum was added to 14 parts of dimethoxyethane, and the resultant mixture was subjected to dispersion treatment by a sand grinder, and the mixture was then diluted with 14 parts of dimethoxyethane and 14 parts of 4-methoxy-4-methylpentanone-2 (manufactured by Mitsubishi Chemical Corporation), and the resultant mixture was further mixed with a solution having 0.5 part of polyvinylbutyral (tradename: "Denkabutyral #6000-C" manufactured by Denki Kagaku Kogyo K.K.) and 0.5 part of phenoxy resin (tradename: UCAR (registered trade mark) PKHH manufactured by Union Carbide Corporation) dissolved in a mixture solvent of 6 parts of dimethoxyethane and 6 parts of 4-methoxy-4-methylpentanone-2 to obtain a dispersion. The dispersion thus obtained was coated by a wire bar on an amino vapor-deposition layer vapor-deposited on a polyester film having a film thickness of 75 μm so as to provide a dry weight of 0.4 g/m$^2$ and was dried to form a charge generation layer.

On the charge generation layer, was coated a coating solution having 70 parts of Compound No. 1 of the above Table 1 and 100 parts of polycarbonate resin of the following formula dissolved in 900 parts of tetrahydrofuran, and dried to form a charge transport layer having a film thickness of 20 μm.

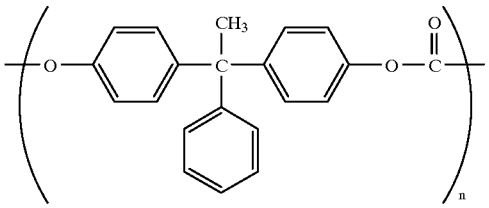

An electrophotographic photoreceptor having a photosensitive layer comprising the above obtained two layers was measured in respect to a sensitivity, i.e. half decay exposure amount, and had a half decay exposure amount of 0.42 μJ/cm$^2$.

The half decay exposure amount was measured by having the photoreceptor negatively charged by a corona current of 50 μA in the dark, exposing the resultant photoreceptor to a light of 780 nm (exposure energy 10 μW/cm$^2$) obtained by passing white light of 20 lux through an interference filter and measuring an exposure amount required to reduce a surface potential from −450V to −225V. Further, a residual potential of a surface potential was measured when an exposure time was 9.9 seconds, and the residual potential thus measured was −1V. This operation was repeated 2,000 times, but the residual potential was not raised.

Also, a Hall drift mobility of the charge transport layer under an electric field intensity of E=2×10$^5$ (V/cm) at a temperature of 21° C. was measured in accordance with TOF method, and the measured Hall drift mobility value was 2.2×10$^{-5}$ (cm$^2$/Vs).

Further, an ionization potential, a polarizability and a dipole moment of the charge transport material (Compound No. 1 of the above Table 1) were calculated in accordance with MOPAC93, and as this calculation result, the charge transport material had ionization potential=8.07 eV, polarizability αcal=93.7 (Å$^3$) and dipole moment Pcal=0.79 (D).

Example 2

An electrophotographic photoreceptor was obtained in the same manner as in Example 1, except that Compound No. 2 of the above Table 1 was used in place of the arylamine type compound used in Example 1.

Thereafter, in the same manner as in Example 1, with regard to the electrophotographic photoreceptor thus obtained, a sensitivity, a residual potential and a mobility were measured, and an ionization potential, a polarizability and a dipole moment were calculated. The results are shown in the following Table 2, together with the result of the photoreceptor of Example 1.

Further, the charge transport material (Compound No. 2 of the above Table 1) was measured in respect to a polarizability and a dipole moment in accordance with the literature "J. Chem. Phys. 75, 3572 (1981)", and had polarizability α=130.4 (Å$^3$) and dipole moment P=1.37(D).

Example 3

An electrophotographic photoreceptor was obtained in the same manner as in Example 1, except that Compound No. 4 of the above Table 1 was used in place of the arylamine type compound used in Example 1.

Thereafter, in the same manner as in Example 1, the electrophotographic photoreceptor was measured in respect to a sensitivity, a residual potential and a mobility, and an ionization potential, a polarizability and a dipole moment were calculated. The results are shown in the following Table 2, together with the measurement results of the photoreceptor of Example 1.

Comparative Example 1

A comparative electrophotographic photoreceptor was obtained in the same manner as in Example 1, except that the following Comparative Compound was used in place of the arylamine type compound used in Example 1.

Comparative Compound 1

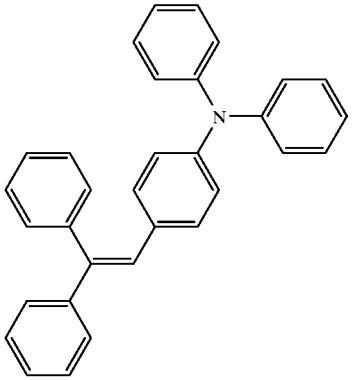

Thereafter, in the same manner as in Example 1, the comparative photoreceptor was measured in respect to a sensitivity, a residual potential and a mobility, and an ionization potential, a polarizability and a dipole moment were calculated. The results are shown in the following Table 2, together with the measurement results of Example 1.

Comparative Example 2

A comparative electrophotographic photoreceptor was obtained in the same manner as in Example 1, except that the following Comparative Compound 2 was used in place of the arylamine type compound used in Example 1.

Comparative Compound 2

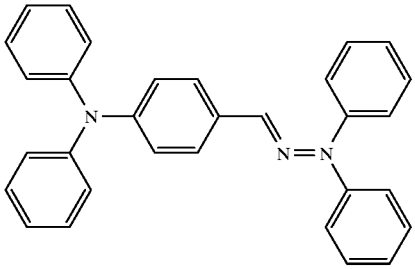

Thereafter, in the same manner as in Example 1, the comparative photoreceptor was measured in respect to a sensitivity, a residual potential and a mobility, and an ionization potential, a polarizability and a dipole moment were calculated. The results are shown in the following Table 2, together with the measurement results of the photoreceptor of Example 1.

Comparative Example 3

A comparative electrophotographic photoreceptor was obtained in the same manner as in Example 1, except that the following Comparative Compound 3 was used in place of the arylamine type compound used in Example 1.

Comparative Compound 3

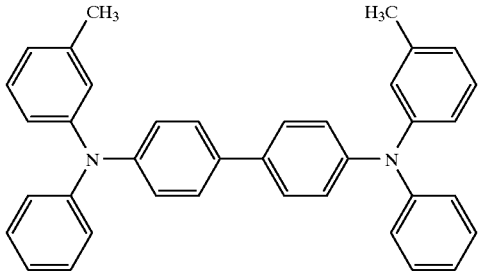

Thereafter, in the same manner as in Example 1, a comparative photoreceptor was measured in respect to a sensitivity, a residual potential and a mobility, and an ionization potential, a polarizability and a dipole moment were calculated. The results are shown in the following Table 2, together with the measurement results of the photoreceptor of Example 1.

Comparative Example 4

A comparative electrophotographic photoreceptor was obtained in the same manner as in Example 1, except that the following Comparative Compound 4 was used in place of the arylamine type compound used in Example 1.

Comparative Compound 4

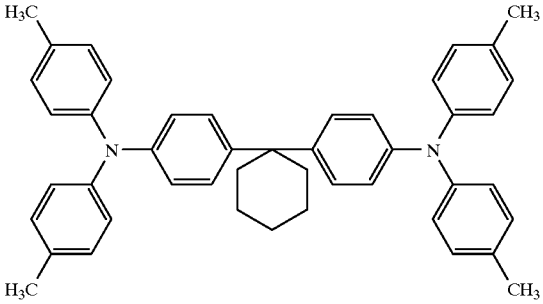

Thereafter, in the same manner as in Example 1, the comparative photoreceptor was measured in respect to a sensitivity, a residual potential and a mobility, and an ionization potential, a polarizability and a dipole moment were calculated. The results are shown in the following Table 2, together with the measurement results of the photoreceptor of Example 1.

Comparative Example 5

A comparative electrophotographic photoreceptor was obtained in the same manner as in Example 1, except that the following Comparative Compound 5 was used in place of the arylamine type compound used in Example 1.

Comparative Compound 5

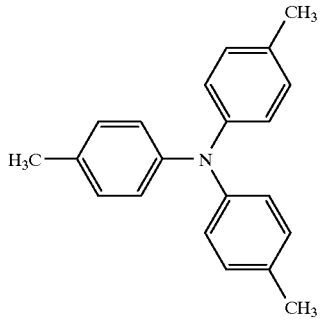

Thereafter, in the same manner as in Example 1, the comparative photoreceptor was measured in respect to a sensitivity, a residual potential and a mobility, and an ionization potential, a polarizability and a dipole moment were calculated. The results are shown in the following Table 2, together with the measurement results of the photoreceptor of Example 1.

Comparative Example 6

A comparative electrophotographic photoreceptor was obtained in the same manner as in Example 1, except that the following Comparative Compound 6 was used in place of the arylamine type compound used in Example 1.

Comparative Compound 6

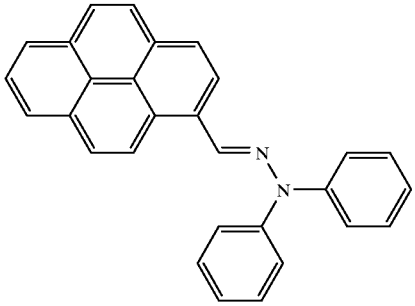

Thereafter, in the same manner as in Example 1, the comparative photoreceptor was measured in respect to a sensitivity, a residual potential and a mobility, and an ionization potential, a polarizability and a dipole moment were calculated. The results are shown in the following Table 2, together with the measurement results of the photoreceptor of Example 1.

TABLE 2

| | | Example 1 | Example 2 | Example 3 |
|---|---|---|---|---|
| | Mobility ($cm^2/Vs$) | $1.7 \times 10^{-5}$ | $2.2 \times 10^{-5}$ | $3.7 \times 10^{-5}$ |
| | Sensitivity ($\mu J/cm^2$) | 0.41 | 0.42 | 0.47 |
| | Residual potential (V) | −1 | −1 | −1 |
| Calculated Values | Ionization potential (eV) | 8.07 | 8.05 | 8.02 |
| | Polarizability (Å$^3$) | 93.7 | 94.5 | 135.8 |
| | Polarizability/ molecular weight | 0.126 | 0.125 | 0.132 |
| | Polarizability/ volume | 0.128 | 0.127 | 0.135 |
| | Dipole moment (D) | 0.79 | 1.02 | 1.63 |
| Empirical values | Ionization potential (eV) | 5.20 | 5.17 | |
| | Polarizability (Å$^3$) | | 130.4 | |
| | Polarizability/ molecular weight | | 0.169 | |
| | Dipole moment (D) | | 1.37 | |

| | | Comparative Example 1 | Comparative Example 2 | Comparative Example 3 |
|---|---|---|---|---|
| | Mobility ($cm^2/Vs$) | $1.1 \times 10^{-5}$ | $4.3 \times 10^{-6}$ | $5.2 \times 10^{-6}$ |
| | Sensitivity ($\mu J/cm^2$) | 0.50 | 0.44 | 0.42 |
| | Residual potential (V) | −21 | −4 | −2 |
| Calculated Values | Ionization potential (eV) | 8.21 | 8.14 | 8.17 |
| | Polarizability (Å$^3$) | 44.5 | 47.0 | 54.4 |
| | Polarizability/ molecular weight | 0.105 | 0.107 | 0.105 |
| | Polarizability/ volume | 0.108 | 0.107 | 0.109 |
| | Dipole moment (D) | 0.65 | 2.33 | 0.89 |
| Empirical values | Ionization potential (eV) | 5.44 | 5.29 | 5.31 |
| | Polarizability (Å$^3$) | 62.3 | 65.6 | 75.7 |
| | Polarizability/ molecular weight | 0.147 | 0.149 | 0.147 |
| | Dipole moment (D) | 1.25 | 2.51 | 1.39 |

| | | Comparative Example 4 | Comparative Example 5 | Comparative Example 6 |
|---|---|---|---|---|
| | Mobility ($cm^2/Vs$) | $2.1 \times 10^{-5}$ | $6.7 \times 10^{-6}$ | $1.7 \times 10^{-6}$ |
| | Sensitivity ($\mu J/cm^2$) | 0.51 | 0.45 | 0.50 |
| | Residual potential (V) | −7 | −14 | −54 |
| Calculated Values | Ionization potential (eV) | 8.17 | 8.18 | 8.04 |
| | Polarizability (Å$^3$) | 61.4 | 28.5 | 46.2 |
| | Polarizability/ molecular weight | 0.098 | 0.099 | 0.117 |
| | Polarizability/ volume | 0.099 | 0.098 | 0.127 |
| | Dipole moment (D) | 1.26 | 0.79 | 2.15 |
| Empirical values | Ionization potential (eV) | | | |
| | Polarizability (Å$^3$) | | | |
| | Polarizability/ molecular weight | | | |
| | Dipole moment (D) | | | |

As evident from the above Table 2, Examples 1, 2 and 3 provide excellent mobility, sensitivity and residual potential as compared with Comparative Examples 1, 2, 3, 4, 5, and 6.

Compound No. 4 of the above Table 1 (Example 3) which is a novel compound was synthesized in the following manner.

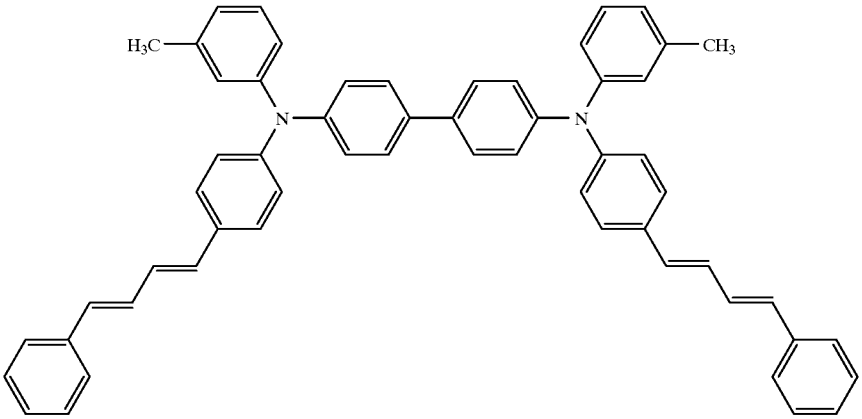

10 g of a compound of the above formula was dissolved in 50 ml of dimethylformamide, and 5.6 g of phosphorus oxychloride heated to 40° C. was dropwise added thereto (heat-generation of 40 to 70° C.). The reaction solution was stirred for 3 hours while controlling at a temperature of 70±5° C. After allowing to cool to 40° C., the reaction solution was poured little by little into a NaOH aqueous solution (water 100 ml, ice 50 g and NaOH 20 g). After stirring the solution for 2 hours, the solution was filtrated under a reduced pressure. A solid separated by filtration was washed with 10 ml of water twice, and was dissolved in 20 ml of dimethylformamide, and was placed in 30 ml of methanol to obtain 9.1 g (85%) of a yellow solid of bisformyl compound having the following structural formula.

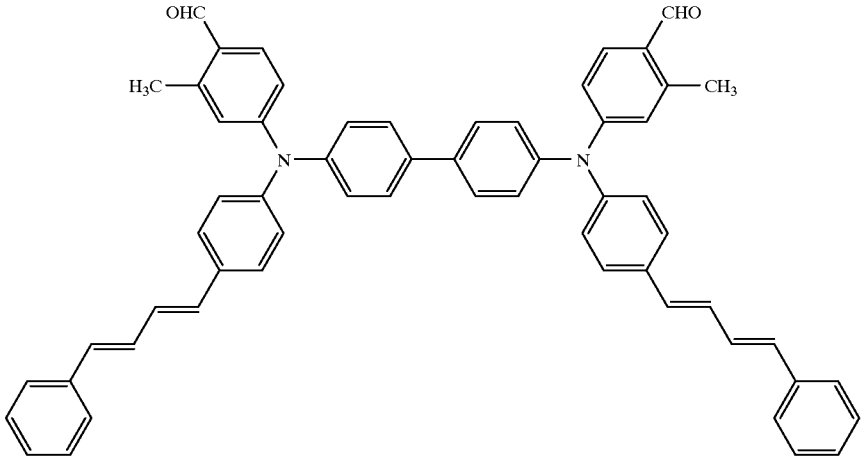

5 g of the bisformyl compound thus obtained and 5.5 g of cinnamyltriphenylphosphonium bromide were dissolved in 30 ml of tetrahydrofuran. The resultant reaction solution was maintained at 20±5° C., and 4 g of 28% solution of sodium methylato methanol was added thereto little by little (heat-generation). After stirring for 2 hours, the reaction solution was placed in 150 ml of methanol. A precipitate was filtrated, dried and purified by silica gel chromatography, and was crystallized with methanol to obtain 4.1 g (66%) of a yellow solid.

It was proved by the following elemental analysis values and infrared absorption spectrum chart (FIG. 1) that this compound was an arylamine type compound of the following structure, i.e. Compound No. 4 of the above Table 1

(Elemental analysis values)
As $C_{78}H_{64}N_2$

| | C (%) | H (%) | N (%) |
|---|---|---|---|
| Calculated values | 91.01 | 6.27 | 2.72 |
| Measured values | 90.90 | 6.40 | 2.65 |

(Mass spectrometric analysis results)
As $C_{78}H_{64}N_2$
Mw=1029
$Mw^+$=1029

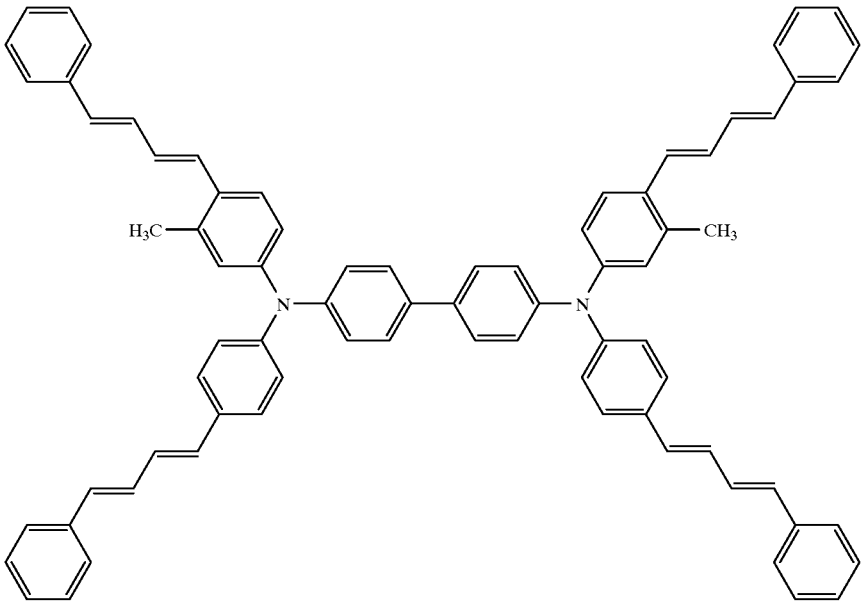

The electrophotographic photoreceptor of the present invention has excellent characteristics that a mobility and a sensitivity are very high, that a residual potential which causes a fogging is small, and that since a photo-fatigue is little, accumulation of a residual potential and variations in a surface potential and a sensitivity due to repeated use are small and consequently a durability is satisfactory.

What is claimed is:

1. An electrophotographic photoreceptor having a photosensitive layer containing a charge generation material and a charge transport material on an electroconductive substrate, wherein the charge transport material has a polarizability α of the formula, α>130 (Å$^3$) and a dipole moment P of the formula, P<1.6 (D).

2. The electrophotographic photoreceptor according to claim 1, wherein the charge transport material satisfies the formula, α/Mw>0.16 (Å$^3$) or α/P>60 (Å$^3$/D) (α: polarizability, Mw: molecular weight).

3. The electrophotographic photoreceptor according to claim 1, wherein the photosensitive layer is a laminate comprising a charge generation layer containing a charge generating material and a charge transport layer containing a charge transport material and the charge transport layer contains polycarbonate as a binder and has a Hall mobility $\mu$ of $\mu$>7.5×10$^{-6}$ (cm$^2$/Vs) in an electric field of E=2×10$^{-5}$ (V/cm).

4. The electrophotographic photoreceptor according to claim 1, wherein an ionization potential difference between the charge transport material and the charge generation material is within 0.4 eV.

5. The electrophotographic photoreceptor according to claim 1, which has a charge generation layer containing a charge generation material and a charge transport layer containing a charge transport material, wherein an ionization potential difference between the charge transport layer and the charge generation layer is within 0.2 eV.

6. The electrophotographic photoreceptor according to claim 1, wherein the charge transport material has an ionization potential of from 5 to 5.4 eV.

7. The electrophotographic photoreceptor according to claim 1, wherein the photoreceptor has an undercoating layer or uses alumite as a base tube.

8. The electrophotographic photoreceptor according to claim 1, wherein the charge generation material is an azo compound having a structure of the following formula (I) and/or (II) as a coupler.

(I)

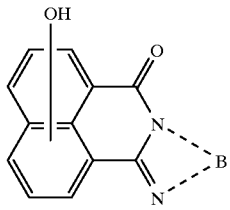

-continued (II)

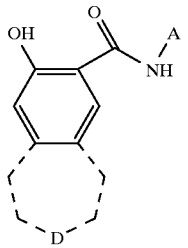

9. The electrophotographic photoreceptor according to claim 1, wherein the photosensitive layer contains a phthalocyanine compound as a charge generation material.

10. The electrophotographic photoreceptor according to claim 1, wherein the photosensitive layer contains an oxytitanium phthalocyanine or a non-metallic phthalocyanine as the charge generation material.

11. The electrophotographic photoreceptor according to claim 1, wherein the photosensitive layer contains an oxytitanium phthalocyanine having the main diffraction peak at a Bragg angle (2θ±0.2°) of 27.3° in an X-ray diffraction spectrum or an oxytitanium phthalocyanine having the main diffraction peaks at Bragg angles (2θ±0.2°) of 9.3°, 13.2°, 26.2° and 27.1°, as the charge generation material.

12. The electrophotographic photoreceptor according to claim 1, wherein the photosensitive layer is a laminate comprising a charge generation layer containing a charge generating material and a charge transport layer containing a charge transport material and the charge generation layer contains a charge generation material and a binder.

13. An electrophotographic photoreceptor having a photosensitive layer containing a charge generation material and a charge transport material on an electroconductive substrate, wherein the charge transport material has a polarizability α of a calculated value αcal of the formula, αcal>90 ($Å^3$) by structure-optimization calculation in accordance with semi-empirical molecular orbital calculation using PM3 parameter (hereinafter simply referred to as "semi-empirical molecular orbital calculation") and a dipole weight.

14. The electrophotographic photoreceptor according to claim 13, wherein the charge transport material satisfies the formula αcal/Mw>0.125 ($Å^3$) (αcal: a calculated value of a polarizability by semi-empirical molecular orbital calculation, Mw: molecular weight, V: a calculated value of van der Waals volume of a molecule having a molecular structure determined by semi-empirical molecular orbital calculation).

15. The electrophotographic photoreceptor according to claim 13, wherein a calculated value of ionization potential of the charge transport material by semi-empirical molecular orbital calculation is from 7.9 to 8.3 eV.

16. The electrophotographic photoreceptor according to claim 13, wherein the photosensitive layer is a laminate comprising a charge generation layer containing a charge generating material and a charge transport layer containing a charge transport material and the charge transport layer contains polycarbonate as a binder and has a Hall mobility $\mu$ of $\mu>7.5\times10^{-6}$ ($cm^2/Vs$) in an electric field of $E=2\times10^{-5}$ (V/cm).

17. The electrophotographic photoreceptor according to claim 13, wherein an ionization potential difference between the charge transport material and the charge generation material is within 0.4 eV.

18. The electrophotographic photoreceptor according to claim 13, which has a charge generation layer containing a charge generation material and a charge transport layer containing a charge transport material, wherein an ionization potential difference between the charge transport layer and the charge generation layer is within 0.2 eV.

19. The electrophotographic photoreceptor according to claim 13, wherein the photoreceptor has an undercoating layer or uses alumite as a base tube.

20. The electrophotographic photoreceptor according to claim 13, wherein the charge generation material is an azo compound having a structure of the following formula (I) and/or (II) as a coupler.

(I)

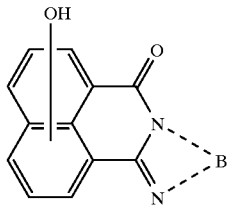

(II)

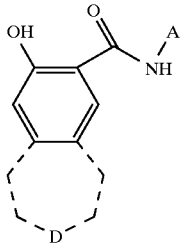

21. The electrophotographic photoreceptor according to claim 13, wherein the photosensitive layer contains a phthalocyanine compound as a charge generation material.

22. The electrophotographic photoreceptor according to claim 13, wherein the photosensitive layer contains an oxytitanium phthalocyanine or a non-metallic phthalocyanine as the charge generation material.

23. The electrophotographic photoreceptor according to claim 13, wherein the photosensitive layer contains an oxytitanium phthalocyanine having the main diffraction peak at a Bragg angle (2θ±0.2°) of 27.3° in an X-ray diffraction spectrum or an oxytitanium phthalocyanine having the main diffraction peaks at Bragg angles (2θ±0.2°) of 9.3°, 13.2°, 26.2° and 27.1°, as the charge generation material.

24. An electrophotographic photoreceptor having a photosensitive layer which is a laminate comprising a charge generation layer containing a charge generating material and a charge transport layer containing a charge transport material and contains an aryl amine compound of the following formula (1) on an electroconductive substrate:

(1)

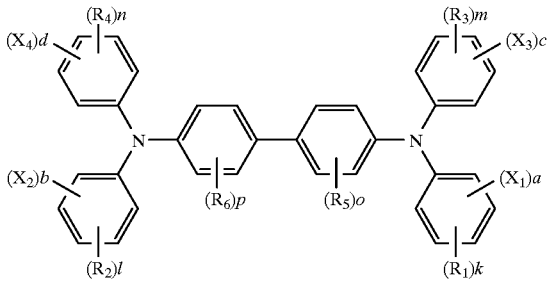

wherein in the formula (1), each of $R_1$, $R_2$, $R_3$, $R_4$, $R_5$ and $R_6$ is a halogen atom, an alkyl which may have a substituent, an alkoxy group which may have a substituent, an aryl group which may have a substituent or a substituted amino group, and they may be the same or different; each of k, l, m, n, o and p is zero or an integer of 1 to 4, and when the integer is 2 or more, a plurality of $R_1$ or $R_6$ may the same or different; $X_1$ is a group of the formula (2), $$-(CR_7{=}CR_8)_i CR_9{=}CR_{10}R_{11} \quad (2)$$

and each of $X_2$, $X_3$ and $X_4$ is a group of the formula (2'), $$-(CR_{12}{=}CR_{13})_h CR_{14}{=}CR_{15}R_{16} \quad (2')$$

(in the formulas (2) and (2'), is an integer of at least 1, h is zero or an integer of 1 or more, each of $R_7$, $R_8$, $R_9$, $R_{10}$, $R_{11}$, $R_{12}$, $R_{13}$, $R_{14}$, $R_{15}$ and $R_{16}$ is a hydrogen atom, an alkyl group which may have a substituent, an alkoxy group which may have a substituent, an aryl group which may have a substituent or a heterocyclic group which may have a substituent, and they may the same or different, provided that with respect to the pair of $R_{10}$ and $R_{11}$ or the pair of $R_{15}$ and $R_{16}$, when one is a hydrogen atom or an alkyl group, the other is an aryl group or a heterocyclic group, or the pair of $R_{10}$ and $R_{11}$ or the pair of $R_{15}$ and $R_{16}$ may be condensed to form a carbocyclic group or a heterocyclic group, and when i is 2 or more, each of $R_7$ and $R_8$ may be the same or different, and when h is 2 or more, each of $R_{12}$ and $R_{13}$ may be the same or different), and they may be respectively the same or different; and each of a, b, c and d is an integer of 1 or 2.

* * * * *